US005885111A

United States Patent [19]

Yu

[11] Patent Number: 5,885,111

[45] Date of Patent: Mar. 23, 1999

[54] KEYSTONE JACK FOR DIGITAL COMMUNICATION NETWORKS

[75] Inventor: Chin-Chun Yu, Tu Cheng, Taiwan

[73] Assignee: Shiunn Yang Enterprise Co., Ltd., Taipei Hsien, Taiwan

[21] Appl. No.: 6,179

[22] Filed: Jan. 13, 1998

[51] Int. Cl.[6] ..... H01R 23/62

[52] U.S. Cl. ..... 439/676; 439/941

[58] Field of Search ..... 439/676, 941

[56] References Cited

U.S. PATENT DOCUMENTS

| | | | |
|---|---|---|---|
| 5,454,738 | 10/1995 | Lim et al. | 439/676 |
| 5,586,914 | 12/1996 | Foster, Jr. et al. | 439/676 |
| 5,647,770 | 7/1997 | Belopolsky | 439/676 |
| 5,700,167 | 12/1997 | Pharney et al. | 439/676 |
| 5,766,043 | 6/1998 | Talend et al. | 439/676 |

*Primary Examiner*—Steven L. Stephan
*Assistant Examiner*—Barry Standig
*Attorney, Agent, or Firm*—Browdy and Neimark

[57] ABSTRACT

An improved modular jack, and more particularly to a keystone jack for use on digital communication networks intends to effectively avoid short circuits and the production of noise and crosstalk in signal transmission. The jack is equipped with a wire mounting plate having four receiving grooves on the top face and four on the bottom face thereof some of which are crossly oriented at their ends so as to permit 8 or more wire contact pieces to be mounted separately thereto and crossly placed without contact at all. A retaining board is integrally engaged with the top face of the wire mounting plate and the combination is forced into a receiving recess of a jack housing having a horizontal extension to support the bottom face of the wire mounting plate so as to fix the 8 wire contact pieces respectively in place. Then a wire limiting cap having a horizontally defined cable insertion hole is engaged with the jack housing so as to permit a cable to be vertically led into the jack with its 8 wires connected to the horizontal wire contact pieces.

2 Claims, 5 Drawing Sheets

KEYSTONE JACK FOR DIGITAL COMMUNICATION NETWORKS

BACKGROUND OF THE INVENTION

The present invention relates to an improved modular jack, and more particularly to a keystone jack for use on digital communication networks which intends to effectively avoid short circuits and the production of noise and crosstalk in operation. The jack is equipped with a wire mounting plate having four receiving grooves on the top face and four on the bottom face thereof some of which are crossly oriented at their ends so as to permit 8 or more wire contact pieces to be mounted separately thereto and crossly placed without contact at all. A retaining board is integrally engaged with the top face of the wire mounting plate and the combination is forced into a receiving recess of a jack housing having a horizontal extension to support the bottom face of the wire mounting plate so as to fix the 8 wire contact pieces respectively in place. Then a wire limiting cap having a horizontally defined cable insertion hole is engaged with the jack housing so as to permit a cable to be vertically led into the jack with its 8 wires connected to the horizontal wire contact pieces Nowadays, technologies and applications in the information and communication related industries have been developed in a fast and versatile manner. In practical use, most consumers or users are primarily concerned with the quality of signal transmissions, for example, the speed and stability of signal transmissions in one aspect; and the readiness in installation of such equipment in another aspect. So, there are many standards or criterion set up to make the quality of signal transmission s live up to such expectations. For instance, the cross arrangement without contact of the metallic wire contact pieces can help the signal transmission in high speed remain stable. However, the quality of signal transmission can not meet the requirements due to the cross arrangement of wire contact pieces crowdedly placed on one face being poor in conventional jack.

There are a number of disadvantages associated with the prior art jack designs found in practical use:

1. The metallic wire contact pieces placed on the same side of a conventional jack must be closely arranged, resulting in easy contact with each other to cause short circuits between the metallic contact pieces in signal transmissions. So, signal transmissions become unstable and poor in practical operations.
2. In common jacks, the metallic wire contact pieces are not directly connected to the wires of a cable, causing problems in a production process and easily resulting in signal attenuation in practical use.
3. In common jacks, the upper cover is provided with linear grooves for housing the wires of a cable, making the insertion of wires difficult; besides, a groove can only accommodate a single wire of a cable and no additional externally connected wires can be received.

SUMMARY OF THE INVENTION

Therefore, the primary object of the present invention is to provide an improved keystone jack which can effectively prevent metallic wire contact pieces from accidentally short circuiting with each other with some of the wire contact pieces crossly arranged without contact by placing 4 wire contact pieces on one face and 4 on the opposite face of a wire mounting plate.

Another object of the present invention is to provide an improved keystone jack which is provided with a wire limiting cap having a horizontal hole into which a cable can be vertically led, permitting the same to be connected to the jack vertically instead of horizontally as usual when the wire limiting cap is secured to the jack housing in assembly.

One still further object of the present invention is to provide an improved keystone jack wherein the wire mounting plate, the retaining board and the horizontal extension of the jack housing having slots provided with two different lengths and alternately disposed at one lateral side thereof so that neighboring wires can be kept far apart in location, preventing accidental short circuits in use.

One still further object of the present invention is to provide an improved jack which makes the insertion of a cable easy and speedy and more than one external wires can be coupled thereto and the connected wires can be firmly retained in place by a wire limiting cap.

One still further object of the present invention is to provide an improved jack which is small in size and is easy to use.

DETAILED DESCRIPTION OF THE PREFERRED EMBODIMENT

Figure 1:
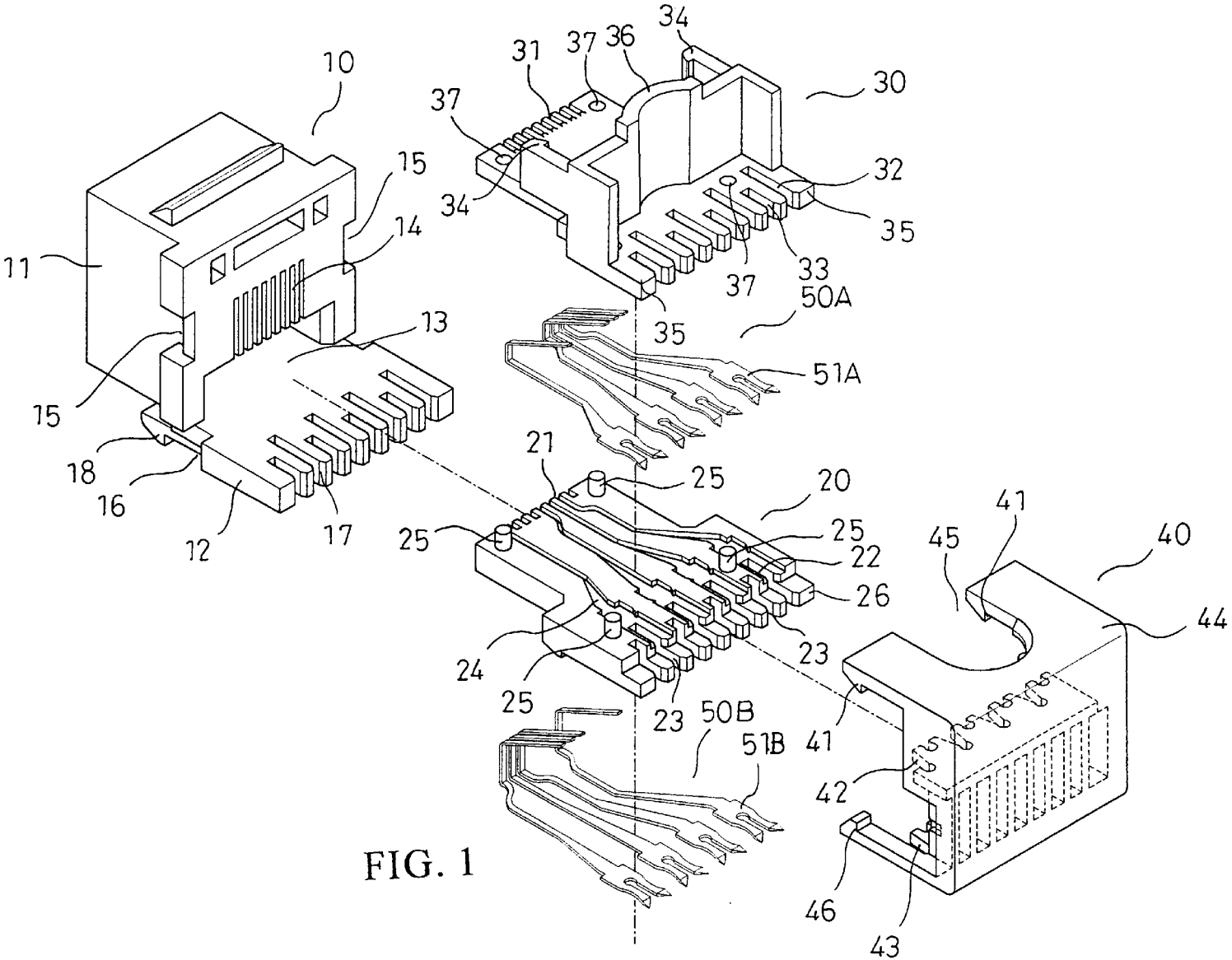
FIG. 1 is a perspective diagram showing the exploded components of the present invention.

As shown in FIG. 1 to FIG. 6, the improved keystone jack of the present invention for use in a digital communication network is comprised of a jack housing 10, a wire mounting plate 20, a retaining board 30, a horizontal wire limiting cap 40 and a plurality of metallic wire contact pieces 50A, 50B.

The jack housing 10 making up of the main portion of the jack has a connector 11 and a horizontal extension 12 projected from the bottom front edge of the connector 11. A receiving recess 13 is defined at the intersection of the connector 11 and the horizontal extension 12. Above the receiving recess 13 are disposed a number of parallel slots 14 for separately retaining the metallic contact pieces 50 in place. At each vertical side of the front face of the connector 11 is disposed a locking cavity 15. At the bottom of the horizontal extension 12 is disposed a locking means 16 at each side thereof.

The wire mounting plate 20 has one lateral side provided with a number of equally spaced ditches 21 half of which further extend to the opposite side thereof to form receiving grooves 24 on the top face of the wire mounting plate 20 and half of which further extend on the bottom face to the opposite side of the wire mounting plate 20 to form receiving grooves 24 on the bottom face thereof.

Figure 4:
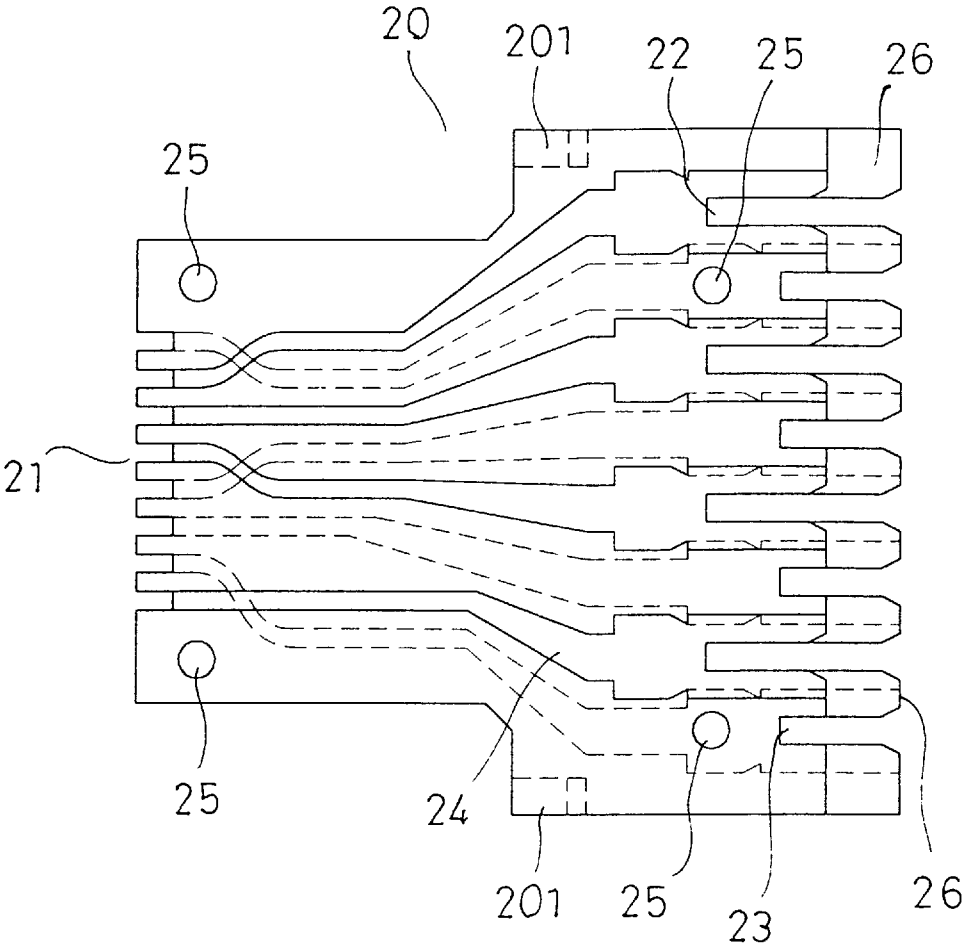
FIG. 4 is a plane view of the arrangement of the wire contact pieces on both faces of the wire mounting plate.
Figure 5:
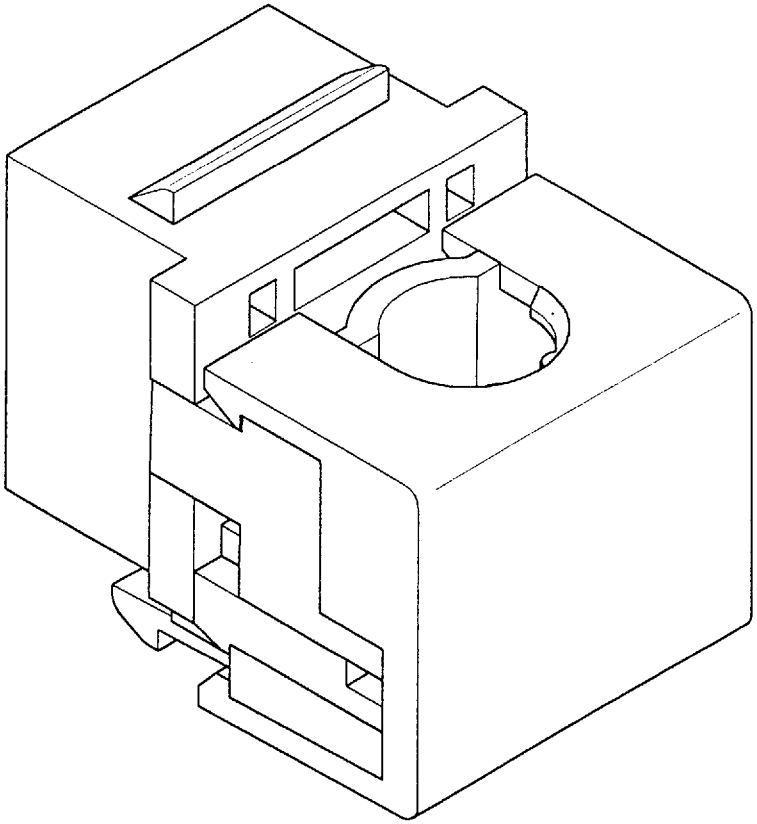
FIG. 5 is a perspective diagram showing the assembly of the present invention.
Figure 6:
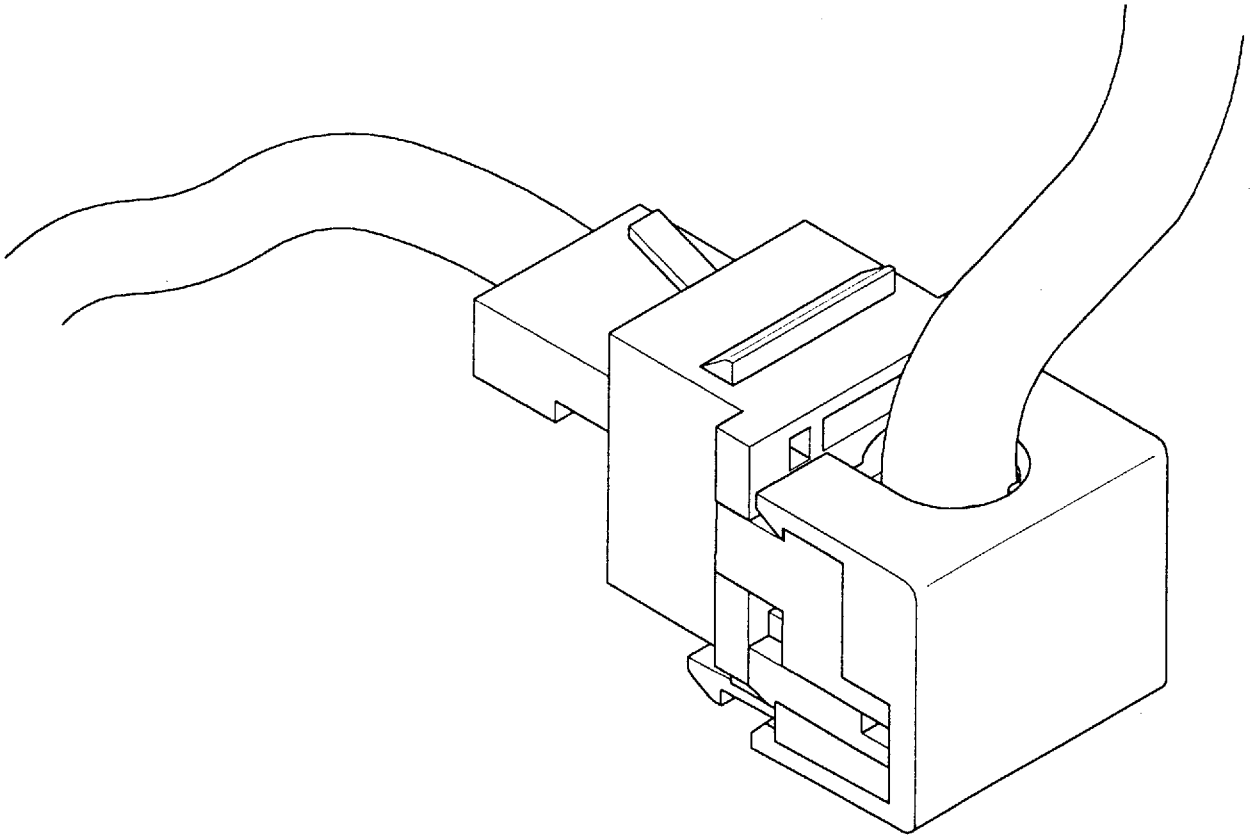
FIG. 6 is a diagram showing the practical application of the present invention.

Referring to FIG. 4, the ditches 21 and their corresponding receiving grooves 24 on the top and bottom face of the wire mounting plate 20 are arranged in such a manner that 3 pairs of the 8 metallic contact pieces 50A, 50B on the top and bottom face are crossly oriented at their ends without the risk of accidental contact with each other as in a conventional jack in which all 8 wires are crowdedly disposed on the same face with part of their ends selectively crossed. Such cross arrangement of the metallic wire contact pieces can not only effectively eliminate crosstalk in signal transmission in the same manner as the wire contact pieces are twisted in pairs in a conventional way but also avoid accidental short circuiting phenomena.

The receiving grooves 24 on the top face of the wire mounting board 20 end up with the first slots 22 and the receiving grooves 24 on the bottom face of the wire mounting board 20 end up with the second slots 23 which are shorter than the first slots 22. The first and the second slots 22, 23 are alternately disposed on the lateral side of the wire mounting plate 20, opposite to the lateral side with the ditches 21.

The first slots 22 and the second slots 23 having different lengths are disposed in communication with the frontmost ends of the respective receiving grooves 24 defined on the top and bottom faces of the wire mounting plate 20 with a row of toes 26 formed at the side of the wire mounting plate 20 as shown in FIG. 4. Thereby 4 first wire contact pieces 50A are housed in the receiving grooves 24 on the top face with their cutting terminals 51A located in the first slots 22; and 4 second wire contact pieces 50B longer than the first wire contact pieces 50A are placed in the receiving grooves 24 on the bottom face of the wire mounting plate with their cutting terminals 51B located in the second slots 23. So, there are two rows of cutting terminals 51A, 51B far apart separated and exposed for ready connection of wires of a cable.

There are 4 joining rods 25 disposed at proper positions on the top face of the wire mounting plate 20 for the purpose of engagement of the wire mounting plate 20 with the retaining board 30.

Referring to FIG. 1, the retaining board 30 disposed right above the wire mounting plate 20 is made up of a bottom board 35 and a vertical partition wall 36 having a longitudinal hooked securing member 34 protruded from each end thereof. The wire mounting plate 20 and the retaining board 30 conform in shape and are integrally engaged with each other . There are a number of partition ditches 31 in conformance to the spaced ditches 21 of the wire mounting plate 20 at one end thereof and a number of spacing slots 32 having alternating lengths in conformance to the first and second slots 22, 23 of the wire mounting plate 20. There are 4 fixing holes 37 in correspondence to the 4 joining rods 25 on the retaining board 30 for engagement purpose.

In assembly, the metallic wire contact pieces 50A, 50B are placed into the respective receiving grooves 24 on both faces of the wire mounting plate 20 with the wire cutting terminals 51A of the first wire contact pieces 50A located in the first slots 22 and the wire cutting terminals 51B of the second wire contact pieces 50B placed in the second slots 23. The bent ends of both the first and second wire cutting terminals 51A, 51B exposedly project from the ditches 21 of the wire mounting plate 20. Then, the retaining board 30 is engaged with and placed on top of the wire mounting plate 20 by registering the fixing holes 37 of the retaining board 30 with the joining rods 25 of the wire mounting plate 20. So, the partition ditches 31 of the retaining board 30 are placed in alignment with the spacing ditches 21 of the wire mounting plate 20. In the same manner, the spacing slots 32 of the retaining board come into alignment with both the first slots 22 and the second slots 23 of the wire mounting plate 20.

The bent ends of the first and second wire contact pieces 50A, 50B are guided into registration with the respective spacing ditches 21 and the division ditches 31, rendering the integral combination of the retaining board 30 and the wire mounting plate 20.

The assembly of the retaining board 30 and the wire mounting plate 20 is slidably guided into the further supported in place by the horizontal extension 12. The hooks 33 of the securing members 34 of the retaining board 30 are in locking engagement with the locking cavities 15 of the jack housing 10. The bent and projected ends of the wire contact pieces 50A, 50B are respectively guided into registration with the parallel slots 14 defined just above the receiving recess 13, producing a securing effect. The horizontal extension 12 can help retain the second wire contact pieces 50B disposed on the bottom face of the wire mounting plate 20 in place.

At the last stage, the wire limiting cap 40 having a top lid 44 provided with a smooth recess 45 is attached to the jack housing 10 by; engaging two hooked ends 41 of the top lid 44 with the edge of the vertical partition wall 36, and the two hooked extensions 46 of the wire limiting cap 40 are engaged with the corresponding locking means 16 of the horizontal extension 12. The wire limiting cap 40 has a wire urging means 400 provided with a row of upper abutment fingers 42 and a row of lower abutment fingers 43 that are in close abutment against the wire cutting terminals 51A, 51B of the first and second wire contact pieces 50A, SOB respectively when the wire limiting cap 40 is mounted onto the jack housing 10.

Figure 3:
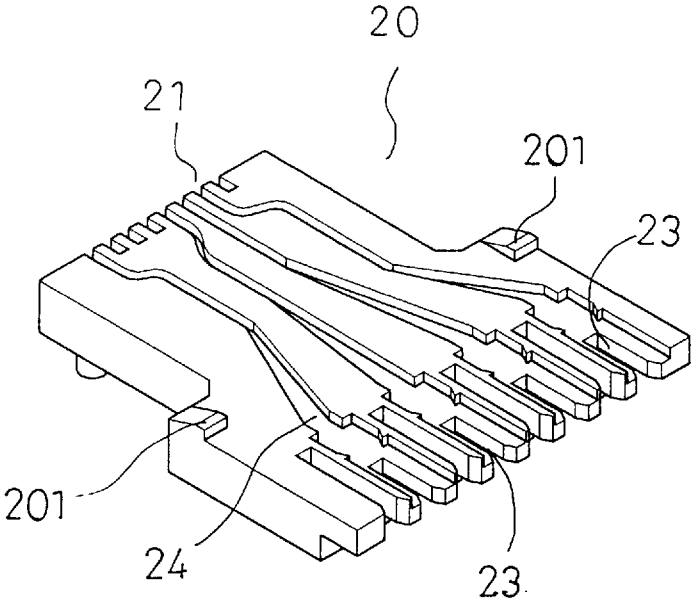
FIG. 3 is a diagram showing the bottom face of the wire mounting plate of the present invention.
Figure 2:
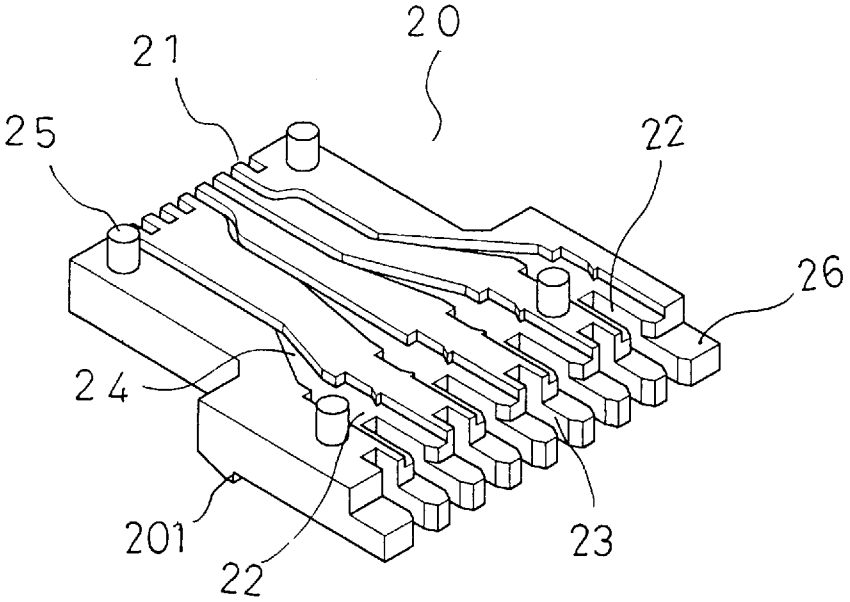
FIG. 2 is a diagram showing the top face of the wire mounting plate of the present invention.

Referring to FIG. 3, when a cable 60 is led into the jack housing 10 via the smooth recess 45 of the wire limiting cap 40, the wires of the cable 60 are placed in the wire cutting terminals 51A, 51B of the first and second wire contact pieces 50A, 50B located in the first slots and second slots 22, 23 defined at the front portion of the receiving grooves 24 respectively. The upper abutment fingers 42 and the lower abutment fingers 43 are in urging abutment against the so placed wires.

It can be clearly seen that the first slots 22 and the second slots 23 of different lengths are alternately disposed so that the wires of the cable 60 engaged with the wire cutting terminals 51A, 51B respectively are far and safely separated, preventing the wires from short circuiting in operation in one aspect; the wire contact pieces 50A, 50B are disposed on both faces of the wire mounting plate 20 with some of the ends of the receiving grooves 24 on both faces of the wire mounting plate 20 are crossly arranged so that the corresponding wire contact pieces 50A, 50B can be crossly arranged without contact at their ends whereby noise and crosstalk can be effectively eliminated in practical operation in another aspect.

I claim:

1. An improved keystone jack for use in a digital communication network, comprising a jack housing, a wire mounting plate, a retaining board, a horizontal wire limiting cap and a plurality of metallic wire contact pieces;

said jack housing having a connector for receiving an external plug means of a communication equipment, and a horizontal extension projected a distance from the bottom of front edge of the connector, a receiving recess being defined on said connector at the intersection of said connector and said horizontal extension;

a plurality of parallel slots being disposed on said connector and right above said receiving recess for separately retaining said wire contact pieces in place;

a locking cavity being defined on either side of said receiving recess and next to said parallel slots, on each vertical side of a front face of said connector being disposed a locking cavity and at the bottom of said horizontal extension being disposed a locking means at each side thereof;

said wire mounting plate having a top face and a bottom face on which being disposed a plurality of receiving grooves for placement of a plurality of said wire contact pieces equally;

a plurality of equally spaced ditches being defined on one lateral side of said wire mounting plate; and a number of joining rods being disposed on said top face of said wire mounting plate; half of said ditches further communicating with said receiving grooves on the top face of said wire mounting plate, another half of said ditches being in communication with said receiving grooves on said bottom face of said wire mounting plate;

said receiving groove on said top face for housing said first wire contact pieces being shorter than said receiving grooves on said bottom face for placement of said second wire contact pieces, defining a plurality of toes on the opposite side of said wire mounting plate;

said ditches and their corresponding receiving grooves on the top and bottom faces of said wire mounting plate being arranged in such a manner that a number of pairs of said metallic wire contact pieces on the top and bottom face of said mounting plate being cross oriented at their ends without contact with each other by preventing wires of a cable from being disposed in crowded manner on the same face with part of their ends selectively crossed;

each said receiving groove on the top face of said wire mounting plate ending up with said first slot, and each said receiving grooves on the bottom face of said wire mounting plate terminating with said second slots;

said first and second slots being alternately disposed on the lateral side of the wire mounting plate, opposite to the lateral side with said ditches;

said wire retaining board having a bottom board and a vertical partition wall disposed on said bottom board which conforming to said wire mounting plate in shape and having a number of ditches on one lateral side in conformance to said ditches on said wire mounting plate;

on each end of said vertical partition wall being disposed an axial securing member having a hooked end engaged with said locking cavity respectively of said connector in assembly;

said first and second wire contact pieces all having a wire cutting terminal at one end and a vertically erected and bent portion at the other end that being received in spaced manner in said ditches of both said wire mounting plate and said wire retaining board;

said first and second wire contact pieces being placed in said receiving grooves on said top and bottom face of said wire mounting plate respectively with said wire cutting terminals located in said first slots and said second slots respectively;

said bottom board of said wire retaining board having a number of fixing holes in correspondence to said joining rods of said wire mounting plate so as to permit said wire retaining board and said wire mounting plate to be integrally fixed together after said wire contact pieces being mounted onto said wire mounting plate and engaged with said receiving grooves;

said assembled wire retaining board and said wire mounting plate being partially led into engagement with said receiving recess in assembly and being supported in place by said horizontal extension;

said wire limiting cap having a top lid having a smoothly rounded recess horizontally defined thereon for passage of a cable having a plurality of wires packed therein; at the edge of said top lid of said wire limiting cap adjacent said rounded recess being provided with a pair of symmetric hooked ends; at the bottom of said wire limiting cap being provided with a pair of hooked extensions in alignment with said hooked ends of said top lid so as to permit said wire limiting cap to be engaged with said vertical partition wall of said wire retaining board and locking means defined at the sides of said horizontal extension when said wire limiting cap being snapped into engagement with said jack housing;

a wire urging means housed in said wire limiting cap having a row of upper abutment fingers and a lower abutment fingers that are in close contact against said wire cutting terminals of said first and second wire contact pieces when said wire limiting cap being secured to said jack housing, resulting in said wires of a cable disposed in said two rows of said first and second slots being cut and exposed by said wire cutting terminals and electrically contacted with said metallic wire contact pieces as a result of said wire limiting cap being forced into engagement with said jack housing;

said wire contact pieces received in said receiving grooves respectively on said top face and bottom face of said wire mounting plate being arranged in such a manner that some of said wire contact pieces on said top face and some of said wire contact pieces on said bottom face being cross oriented at their ends without contact so as to reduce noise and crosstalk in signal transmission.

2. The improved keystone jack as claimed in claim 1 wherein said slots on the front edge of said horizontal extension of said jack housing and said slots on said wire retaining board and said first and second slots on said wire mounting plate have two different lengths and are alternately placed so as to permit consecutive wires of a cable to be located in said slots far apart, resulting in preventing said wires of an inserted cable from accidental contact with each other to cause short circuiting in operation.

* * * * *